US009102495B2

(12) United States Patent
Sugawara

(10) Patent No.: US 9,102,495 B2
(45) Date of Patent: Aug. 11, 2015

(54) PAPER EJECTION DEVICE AND IMAGE FORMING APPARATUS

(71) Applicant: Mitsuhiro Sugawara, Kanagawa (JP)

(72) Inventor: Mitsuhiro Sugawara, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 122 days.

(21) Appl. No.: 13/904,186

(22) Filed: May 29, 2013

(65) Prior Publication Data

US 2013/0328960 A1 Dec. 12, 2013

(30) Foreign Application Priority Data

Jun. 7, 2012 (JP) ..... 2012-129519
Feb. 27, 2013 (JP) ..... 2013-037866

(51) Int. Cl.
*B65H 31/20* (2006.01)
*B65H 31/02* (2006.01)

(52) U.S. Cl.
CPC ..... *B65H 31/20* (2013.01); *B65H 31/02* (2013.01); *B65H 2404/742* (2013.01); *B65H 2405/114* (2013.01); *B65H 2511/22* (2013.01); *B65H 2513/10* (2013.01); *B65H 2801/18* (2013.01)

(58) Field of Classification Search
CPC ..... B65H 29/00; B65H 31/00; B65H 31/20; B65H 2405/00; B65H 2405/10; B65H 2405/114; B65H 2405/1142; B65H 2405/11425; B65H 2405/1144
USPC ..... 271/207, 221–223
See application file for complete search history.

(56) References Cited

U.S. PATENT DOCUMENTS

| | | | | |
|---|---|---|---|---|
| 6,073,925 | A * | 6/2000 | Sato | 271/171 |
| 6,264,191 | B1 | 7/2001 | Suzuki et al. | |
| 6,296,247 | B1 | 10/2001 | Tamura et al. | |
| 7,464,930 | B2 * | 12/2008 | Masuda et al. | 271/224 |
| 7,591,465 | B2 * | 9/2009 | Sato | 271/187 |
| 7,748,705 | B2 * | 7/2010 | Yamada | 271/209 |
| 8,950,745 | B2 * | 2/2015 | Takahashi | 271/221 |
| 2001/0017442 | A1 | 8/2001 | Suzuki et al. | |

FOREIGN PATENT DOCUMENTS

| | | |
|---|---|---|
| JP | H10-001254 | 1/1998 |
| JP | 2000-118845 | 4/2000 |
| JP | 2002-179325 | 6/2002 |
| JP | 3669604 | 4/2005 |
| JP | 2006-306568 | 11/2006 |
| JP | 2009-012397 | 1/2009 |
| JP | 2010-001138 | 1/2010 |

* cited by examiner

*Primary Examiner* — Prasad Gokhale
(74) *Attorney, Agent, or Firm* — Harness, Dickey & Pierce, P.L.C.

(57) ABSTRACT

A paper ejection device holds paper ejected out from an upstream device through a paper-ejection opening of the upstream device. The paper ejection device includes: a pair of side fences arranged parallel and perpendicularly to a paper ejection direction, the paper ejection direction being a direction in which paper is ejected through the paper-ejection opening, to restrict positions of edges of the ejected paper in a width direction; and a control unit that, when an ejection speed at which the paper is ejected through the paper-ejection opening is higher than a predetermined speed, controls spacing between the pair of side fences to be narrower than spacing between the pair of side fences for paper ejected at a speed equal to or lower than the predetermined speed.

8 Claims, 6 Drawing Sheets

PAPER EJECTION DEVICE AND IMAGE FORMING APPARATUS

CROSS-REFERENCE TO RELATED APPLICATIONS

The present application claims priority to and incorporates by reference the entire contents of Japanese Patent Application No. 2012-129519 filed in Japan on Jun. 7, 2012 and Japanese Patent Application No. 2013-037866 filed in Japan on Feb. 27, 2013.

BACKGROUND OF THE INVENTION

1. Field of the Invention

The present invention generally relates to a paper ejection device and an image forming apparatus.

2. Description of the Related Art

Certain types of image forming apparatuses, such as stencil printers, adopt a scheme for achieving fine alignment of paper ejected onto a paper output platform by maintaining a deflected profile (elastically bent form) of paper, in which paper end portions in a direction perpendicular to a paper conveying direction are at higher level than a center portion, when the paper is ejected.

For instance, there is adopted a scheme of creating such an elastically bent form using a suction conveying unit and maintaining the elastically bent form using wing-shaped paper ejection supports or the like arranged on side fences of a paper output platform.

For example, Japanese Laid-open Patent Publication No. 2006-306568 discloses a technique for achieving better ejected-paper alignment by configuring side fences in such a manner that spacing between top portions of the side fences is smaller than spacing between bottom portions. Japanese Laid-open Patent Publication No. 2002-179325 discloses a technique of setting spacing between spacing-adjustable side fences to be narrower than a paper width size by a predetermined amount. Japanese Laid-open Patent Publication No. 2000-118845 discloses a technique of decreasing positions of side fences when paper is not thick paper. This technique utilizes relationship with a result of paper thickness detection, but does not take relationship with print speed into account. Japanese Laid-open Patent Publication No. 10-001254 discloses a technique of setting spacing between side fences to be slightly wider or narrower than an actual paper size depending on type and thickness of the paper. Japanese Patent Document No. 3669604 discloses a scheme of automatically adjusting side fences and an end fence to paper size. Japanese Laid-open Patent Publication No. 2009-012397 discloses a control scheme of moving an end fence in a direction away from a paper exit according to a print speed.

However, to the inventor's knowledge, there is not provided a technique that takes relationship between positions of, or spacing between, side fences and a print speed into account. Accordingly, there remains an unsolved problem that an elastically bent form of paper cannot be maintained when high-speed printing is performed, which can result in poor alignment of ejected paper.

Therefore, it is desirable to provide a paper ejection device capable of maintaining an elastically bent form of paper even when high-speed printing is performed by taking relationship between positions of side fences and a print speed into account, thereby preventing poor ejected-paper alignment, and an image forming apparatus including the paper ejection device.

SUMMARY OF THE INVENTION

It is an object of the present invention to at least partially solve the problems in the conventional technology.

According to an aspect of the present invention, there is provided a paper ejection device for holding paper ejected out from an upstream device through a paper-ejection opening of the upstream device, the paper ejection device including: a pair of side fences arranged parallel and perpendicularly to a paper ejection direction, the paper ejection direction being a direction in which paper is ejected through the paper-ejection opening, to restrict positions of edges of the ejected paper in a width direction; and a control unit that, when an ejection speed at which the paper is ejected through the paper-ejection opening is higher than a predetermined speed, controls spacing between the pair of side fences to be narrower than spacing between the pair of side fences for paper ejected at a speed equal to or lower than the predetermined speed.

According to another aspect of the present invention, there is provided an image forming apparatus including: an image forming unit; and a paper ejection device for holding paper ejected out from an upstream device through a paper-ejection opening of the upstream device, the paper ejection device including: a pair of side fences arranged parallel and perpendicularly to a paper ejection direction, the paper ejection direction being a direction in which paper is ejected through the paper-ejection opening, to restrict positions of edges of the ejected paper in a width direction; and a control unit that, when an ejection speed at which the paper is ejected through the paper-ejection opening is higher than a predetermined speed, controls spacing between the pair of side fences to be narrower than spacing between the pair of side fences for paper ejected at a speed equal to or lower than the predetermined speed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described below with reference to the accompanying drawings.

Figure 1:
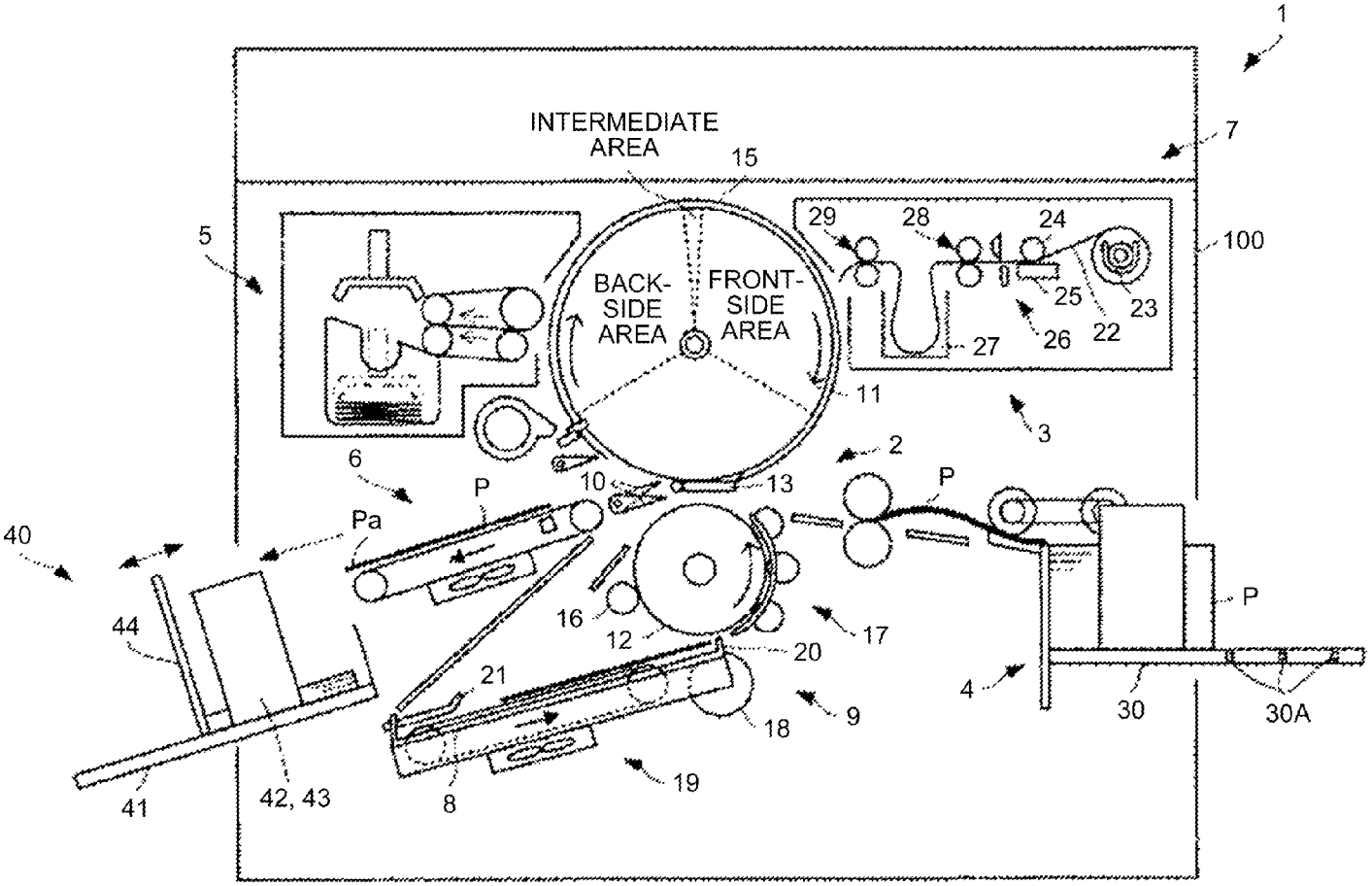
FIG. 1 is an overall configuration diagram illustrating a printer according to an embodiment of the present invention.

FIG. 1 illustrates a printer as an image forming apparatus according to an embodiment of the present invention. Specifically, the printer is a stencil printer 1 that includes a printing unit 2, a master making unit 3, a paper feeding unit 4, a master discharge unit 5, a paper ejection unit 6, an image reading unit 7, an auxiliary tray 8, a paper re-feeding unit 9, a guide member 10, and a paper ejection device 40.

Referring to FIG. 1, the stencil printer 1 includes an apparatus body 100. The printing unit 2 arranged at approximately center of the apparatus body 100 includes a print drum 11 and a pressing roller 12, which is a pressing member. The print drum 11 is removably attached to and rotatably supported by the apparatus body 100 and rotated by a print-drum driving unit (not shown). The print drum 11 includes a clamper 13, which is operable to open and close, on its outer circumferential surface (hereinafter, "the outer surface"). A segmented-and-perforated master (not shown), which is a master made by the master making unit 3, is wrapped around the outer surface of the print drum 11 when duplex printing is to be performed. A perforated master 15, which is a master made by the master making unit 3, is wrapped around the outer surface when single-sided printing is to be performed. A rotary encoder (not shown) for detecting a position of the print drum 11 is arranged near the outer surface of the print drum 11. In the present embodiment, it is assumed that the perforated master 15 usable in printing of up to A3-size paper is wrapped around the print drum 11.

A first master image corresponding to a front-side image and a second master image corresponding to a back-side image are formed on the segmented-and-perforated master (not shown). A not-perforated portion (not shown) is interposed between the first and second master images. The segmented-and-perforated master (not shown) is wrapped around the print drum 11 in such a manner that the first master image is positioned in a front-side area, the second master image is positioned in a back-side area, and the not-perforated portion is positioned in an intermediate area. The perforated master 15 is wrapped around the print drum 11 in such a manner that a master image formed on the master 15 is positioned in a region consisting of the front-side area, the back-side area, and the intermediate area.

The pressing roller 12 is arranged below the print drum 11. The pressing roller 12 is rotatably supported at its two opposite ends by an arm member (not shown). The arm member (not shown) is swingably supported by a swing unit (not shown). The pressing roller 12 is selectively positioned at either a separated position where a circumferential surface of the pressing roller 12 is separated from the print drum 11 or a press-contact position where the circumferential surface is pressed against the segmented-and-perforated master (in a case of duplex printing) on the print drum 11.

The swing unit (not shown) is configured to be capable of switching a pressed region where the print drum 11 is pressed by the pressing roller 12 to any one of a first region, a second region, and a third region. The first region consists of all of the front-side area, the intermediate area, and the back-side area. The second region coincides with the front-side area. The third region consists of a downstream portion of the front-side area, the intermediate area, and the back-side area. A cleaning roller 16 that performs cleaning by coming into contact with the circumferential surface of the pressing roller 12 is arranged near the circumferential surface of the pressing roller 12.

A paper-re-feed guide member 17 is arranged at a position near and to the right of the pressing roller 12. The paper-re-feed guide member 17 conveys paper P, printing on front side of which is completed, fed from the auxiliary tray 8 along the circumferential surface of the pressing roller 12. A paper-re-feed registration roller 18 is arranged below the pressing roller 12. The paper-re-feed registration roller 18 delivers a sheet of the paper P out of the tray 8 by bringing the sheet of the paper P piled on the auxiliary tray 8 into contact with the circumferential surface of the pressing roller 12. A paper-re-feed conveying unit 19 including the auxiliary tray 8 is arranged at a position below and to the reft of the pressing roller 12. The paper-re-feed conveying unit 19 includes a paper-re-feed positioning member 20 formed in one piece therewith. A paper receiving plate 21 that is movable along a top surface of the auxiliary tray 8 is arranged above the paper-re-feed conveying unit 19. The auxiliary tray 8, the paper-re-feed guide member 17, the paper-re-feed registration roller 18, the paper-re-feed positioning member 20, the paper-re-feed conveying unit 19, and the paper receiving plate 21 make up the paper re-feeding unit 9.

The guide member 10 is arranged on a conveying path of the paper P at a position to the left of a contact position between the print drum 11 and the pressing roller 12. The guide member 10 is pivotably supported at its downstream end in the paper conveying direction by the apparatus body 100. The guide member 10 is moved by a moving unit 61, which will be described later, selectively to either a first position indicated by solid lines or a second position indicated by long dashed double-short dashed lines. Whereas the paper P passed through between the print drum 11 and the pressing roller 12 is guided to the paper ejection unit 6 when the guide member 10 is at the first position, the paper P is guided to the auxiliary tray 8 when the guide member 10 is at the second position.

The master making unit 3 is arranged at a position above and to the right of the printing unit 2. The master making unit 3 has a known configuration that includes a master holder 23, a platen roller 24, a thermal head 25, a master cutter 26, a master storage 27, a pair of tension rollers 28, and a pair of reverse rollers 29. The master holder 23 holds a master roll, which is a roll of a stencil master (hereinafter, "master") 22. The master making unit 3 creates the segmented-and-perforated master 14 when duplex printing is performed, but creates the perforated master 15 when single-sided printing is performed.

The paper feeding unit 4 is arranged below the master making unit 3. The paper feeding unit 4 has a known configuration that includes a paper feed tray 30 for holding the paper P, a paper feed roller, a separating roller, a separating pad, and a pair of registration rollers. A plurality of paper-size detecting sensors 30A for detecting a size of the paper P placed on the paper feed tray 30 is arranged on the paper feed tray 30.

The master discharge unit 5 arranged at a position above and to the left of the printing unit 2 has a known configuration that includes an upper master-discharging member, a lower master-discharging member, a discharged master bin, and a compressing plate. The master discharge unit 5 peels off the segmented-and-perforated master (not shown) or the perforated master 15, which has been used, from the outer surface of the print drum 11 and puts the segmented-and-perforated master or the perforated master 15 in the discharged master bin for disposal.

The paper ejection unit 6 is arranged below the master discharge unit 5. The paper ejection unit 6 has a known configuration that includes a peel-off claw, a paper-ejection conveying unit, and a peel-off fan. The paper ejection unit 6 peels off the printed paper P from the outer surface of the print drum 11 and ejects the paper P onto a paper output tray 41 of the paper ejection device 40.

The image reading unit 7 is arranged at a top portion of the apparatus body 100. The image reading unit 7 includes an exposure glass on which an original document is to be placed, a pressure plate movable into contact with and away from the exposure glass, mirrors and a lamp for obtaining a document image by scanning, a lens for converging the scanned image, and an image sensor for processing the converged image, which are not shown.

The paper ejection device 40 includes the paper output tray 41 for holding the printed paper P, a pair of side fences 42 and 43, and an end fence 44. The side fences 42 and 43 are arranged in a width direction of the paper P placed on the paper output tray 41 to restrict positions of edges of the ejected paper P in the width direction. The end fence 44 can come into collision with a leading end Pa of the paper P placed on the paper output tray 41 and is movable in a direction approaching/moving-away-from the apparatus body 100, from which the paper is ejected.

Figure 2:
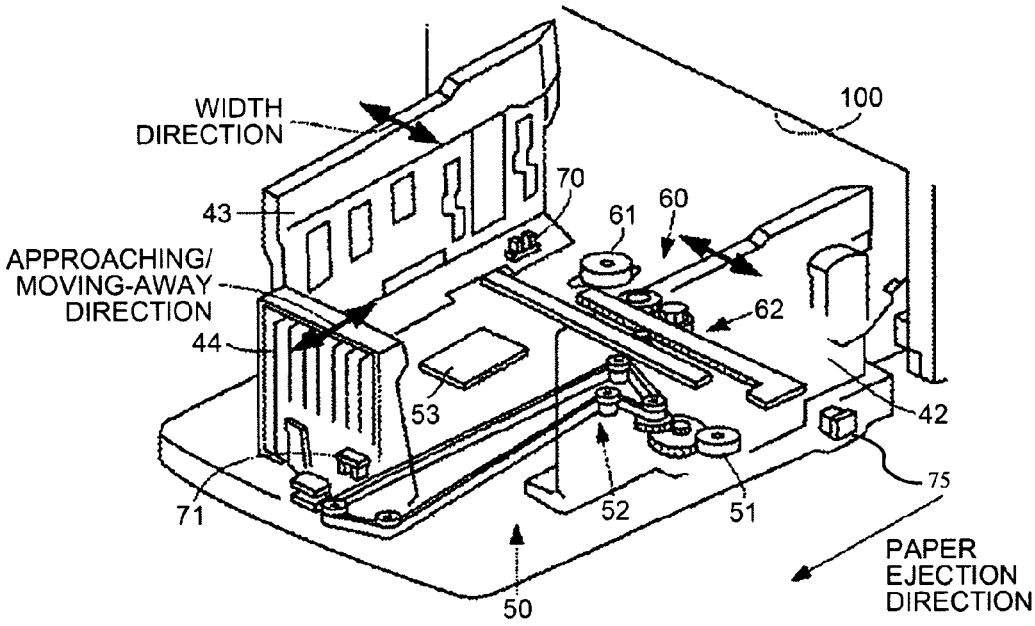
FIG. 2 is an enlarged perspective view illustrating a schematic configuration of a paper ejection device mounted on the printer.

As illustrated in FIG. 2, the paper ejection device 40 includes a fence-position adjustable unit 50 that changes a position where the end fence 44 collides with the leading end Pa of the paper P based on paper-type data by moving the end fence 44. The fence-position adjustable unit 50 includes a fence driving system 52 and a control unit 53 (more specifically, a control unit for the paper ejection device; hereinafter, "the paper-ejection control unit 53"). The fence driving system 52 includes a stepping motor 51 as a driving source that moves the end fence 44 in a direction approaching/moving-away-from the apparatus body 100, which is an upstream device.

The fence driving system 52 is a known belt-and-pulley drive transmission mechanism including a toothed endless belt and a plurality of toothed pulleys looped around the belt. A slider is mounted on a portion of the belt. The slider is fixed to a bottom of the end fence 44. Accordingly, running the stepping motor 51 moves the end fence 44 in one of the approaching direction and the moving-away direction, which depends on a rotating direction of the stepping motor 51. In the present embodiment, it is assumed that the end fence 44 moves in the moving-away direction when the stepping motor 51 rotates forward, but moves in the approaching direction when the stepping motor 51 rotates backward.

As shown in FIG. 2, the moving unit 60 moves the side fences 42 and 43 toward or away from each other in the width direction. The moving unit 60 has a known configuration that includes a stepping motor 61, which is a driving source, and a drive transmitting unit 62 that transmits rotation of the stepping motor 61 to pinions meshing with racks arranged on bottoms of the side fences 42 and 43. Each of the fence-position adjustable unit 50 and the moving unit 60 is internally mounted on the paper output tray 41.

Arranged on the paper output tray 41 are a side-fence-home-position detecting sensor 70 that detects the side fences 42 and 43 at their home position and an end-fence-home-position detecting sensor 71 that detects the end fence 44 at its home position.

Figure 3:
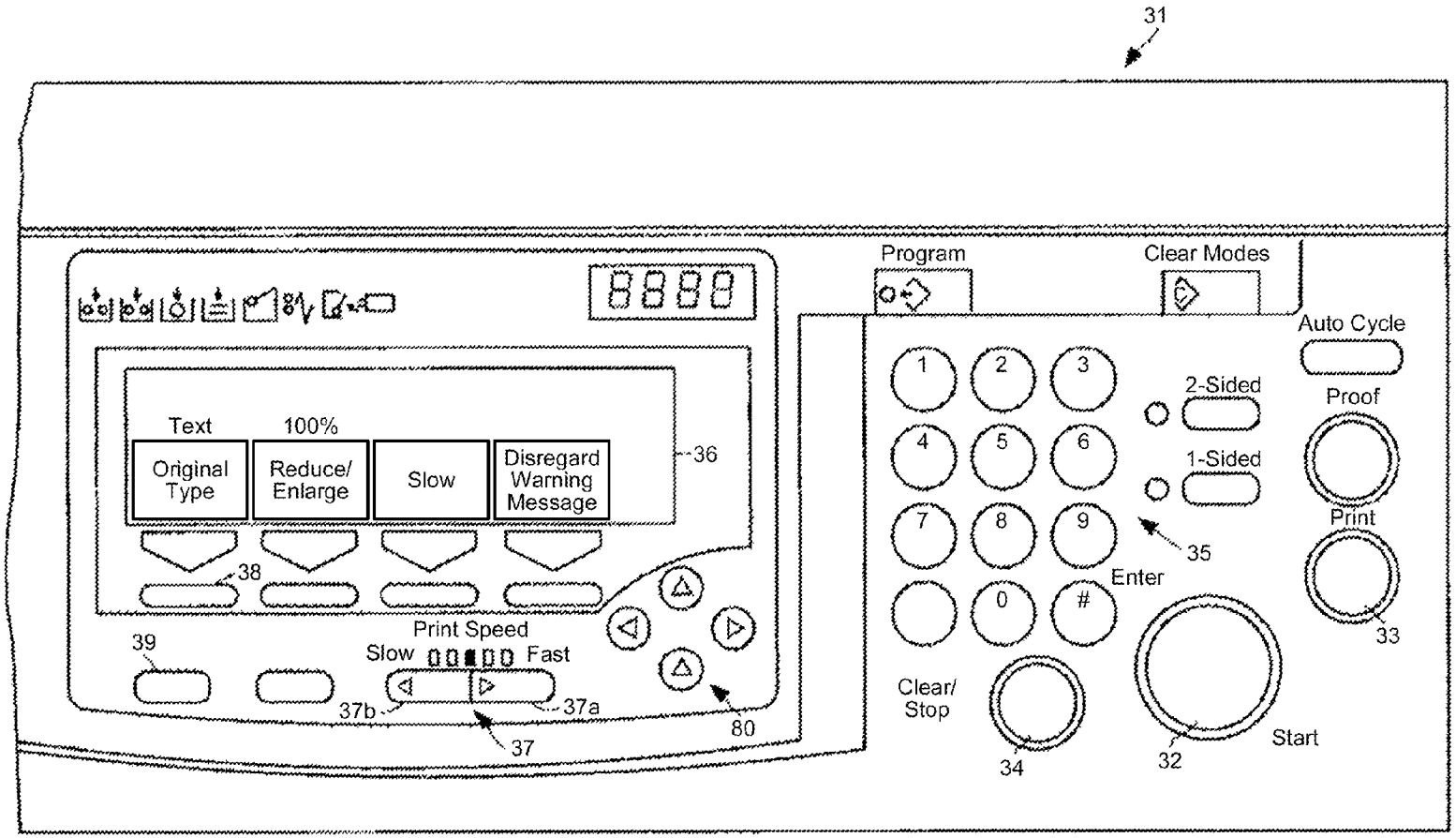
FIG. 3 is an enlarged view illustrating an example of an operation panel included in the printer.

FIG. 3 illustrates an operation panel 31 arranged on the apparatus body 100. Referring to FIG. 3, the operation panel 31 has elements of a known configuration including a master-making start key 32, a print start key 33, a stop key 34, number keys 35, a display unit 36 which is a liquid crystal display (LCD), a duplex printing key (not shown) to be pressed when performing duplex printing, and a single-sided printing (not shown) to be pressed when performing single-sided printing. The operation panel 31 further includes a print-speed setting key 37, which is a setting-configuring unit for specifying a desired print speed from among a plurality of print speeds, a paper-type select key 38 for calling up a paper-type setting screen 101, a fence adjust key 39, which is an operating unit, and direction specifying keys. The display unit 36 is what is generally referred to as a touch panel switch configured to display various information, various switches, and warning messages.

The print-speed setting key 37 is made up of a speedup key 37*a* and a slowdown key 37*b*. Pressing the speedup key 37*a* once increases a current print speed by one level, whereas pressing the slowdown key 37*b* once decreases the current print speed by one level.

Figure 4:
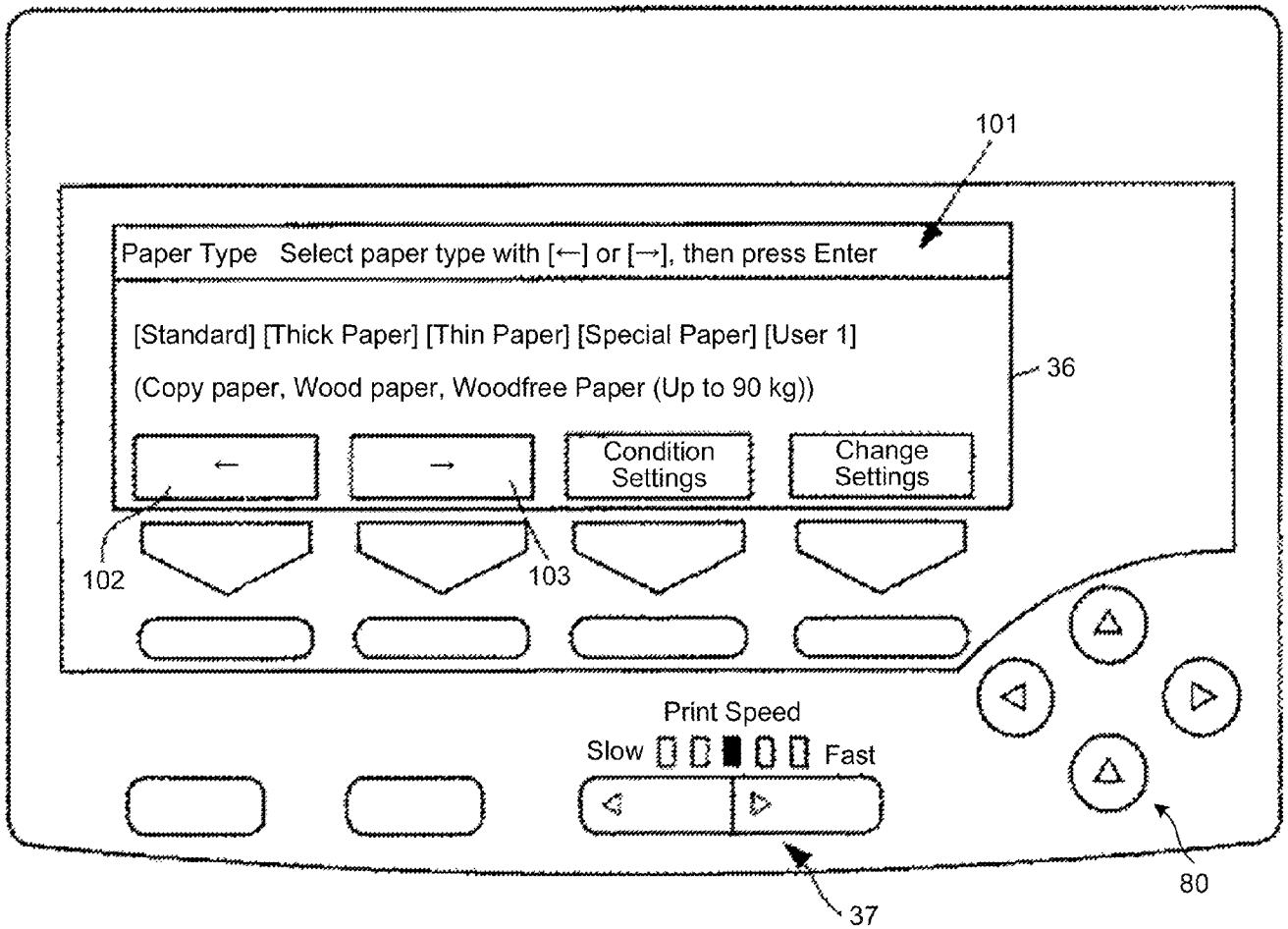
FIG. 4 is an enlarged view illustrating a display unit and elements therearound on the operation panel.

The paper-type select key 38 is to be operated when it is desired to display a setting screen for selecting paper type (thickness) illustrated in FIG. 4 on the display unit 36. Pressing the paper-type select key 38 displays the paper-type select screen 101 illustrated in FIG. 4 on the display unit 36. Elements displayed on the paper-type select screen 101 are paper types correlated with thickness of paper, such as standard, thick paper, thin paper, special, and user, and arrow keys 102 and 103 for making selection from the displayed paper types.

Figure 5:
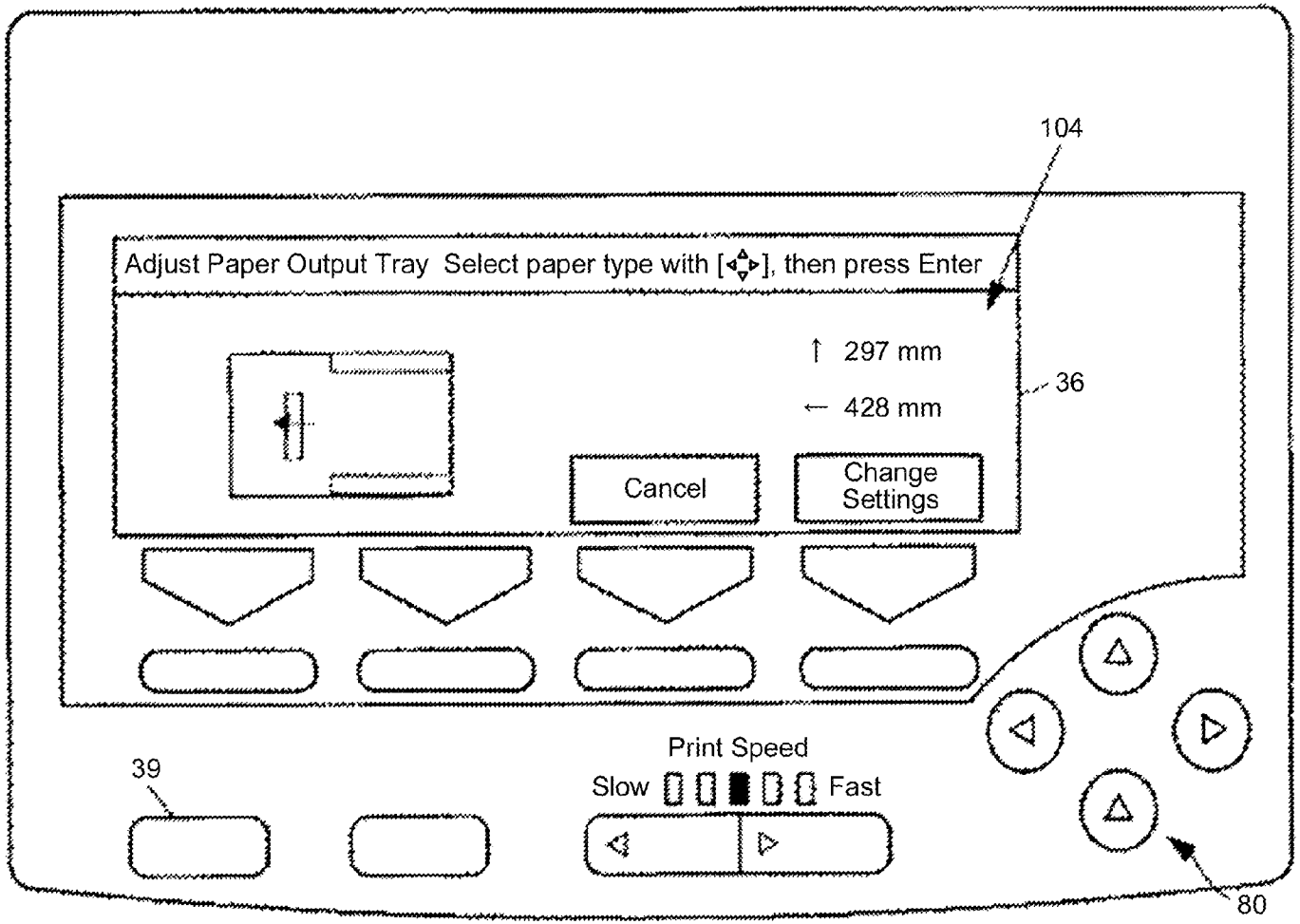
FIG. 5 is an enlarged view of a screen that is to appear on the display unit when an operating unit for use in moving an end fence is operated.

The fence adjust key 39 is used when it is desired to move the side fence 42 and 43 by key operation. Pressing this key causes an adjustment screen 104 for the paper output tray 41 to appear on the display unit 36 as illustrated in FIG. 5. Pressing a fence move key set 80 for specifying a moving direction from among up, down, left, and right directions moves the side fence 42 and 43 in the moving direction specified using the fence move key set 80.

Figure 6:
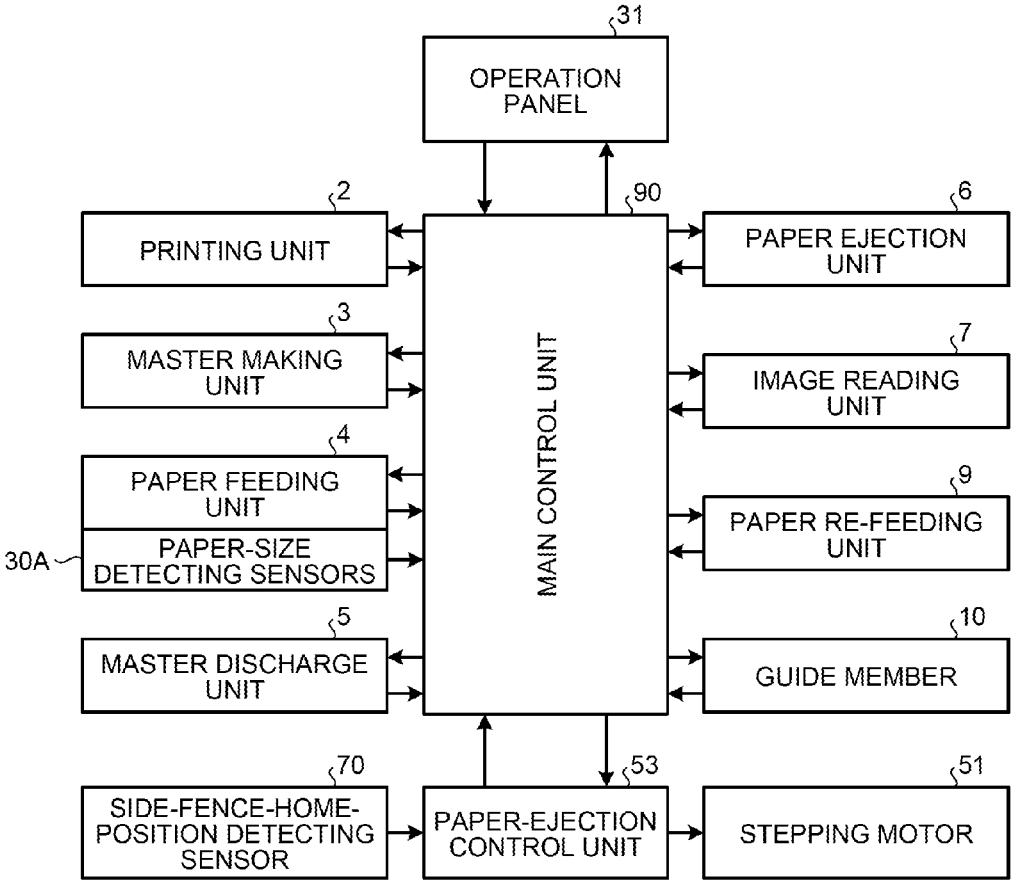
FIG. 6 is block diagram illustrating a configuration of a control system of the printer and the paper ejection device.

FIG. 6 illustrates a configuration of a control system of the present embodiment. The stencil printer 1 includes an apparatus-main-body control unit (hereinafter, "the main control unit") 90 for the apparatus body 100, and the paper-ejection control unit 53 described above for the paper ejection device 40. The main control unit 90 is implemented in a known computer including a central processing unit, a read only memory, and a random access memory. The main control unit 90 controls printing-related operations from document scanning through printing. Specifically, the main control unit 90 controls operations of each of the printing unit 2, the master making unit 3, the paper feeding unit 4, the master discharge unit 5, the paper ejection unit 6, the image reading unit 7, the paper re-feeding unit 9, and the guide member 10 based on operation signals fed from the rotary encoder (not shown) and the operation panel 31. The main control unit 90 and the paper-ejection control unit 53 are connected to each other via a data line and configured to exchange various information with each other.

Print speed data containing a plurality of print speeds is stored in the main control unit 90 in advance. Program instructions for processing steps from master discharging through master making and processing steps for printing are also stored in the main control unit 90. The main control unit 90 starts the program instructions based on data input via the operation panel 31 and/or data output from the paper-size detecting sensors 30A, thereby causing the units to perform corresponding operations.

The paper-ejection control unit 53 controls overall operations of the side fences 42 and 43 and the end fence 44. Basic data about positions of the side fences 42 and 43 and the end fence 44 that vary depending on a print speed and data about corrective positions of the side fences 42 and 43 and the end fence 44 that depend on paper-type data are stored in the paper-ejection control unit 53 in advance. The paper-type data includes sheet size data and sheet thickness data. The basic position data and the corrective position data are stored in a form of number of steps of the stepping motor 51 or 61 taken with reference to the home position of the side fences 42 and 43 or the end fence 44 detected by the side-fence-home-position detecting sensor 70 or the end-fence-home-position detecting sensor 71.

In the present embodiment, the paper-ejection control unit 53 has the following features: a feature that, when a print speed different from a current print speed is set using the print-speed setting key 37 during printing, disables running the stepping motor 51 to move the end fence 44; a feature that, when a print speed faster than a current print speed is set using the print-speed setting key 37 during printing, causing the stepping motor 51 to run so as to move the end fence 44 to a position for the fast print speed; a feature that causes the display unit 36 to display a warning message when moving the end fence 44 is disabled; a feature that causes the stepping motor 51 to run so as to move the end fence 44 to a position that depends on data about a ratio of an image (hereinafter, "image-ratio data") to be printed on the paper P; a feature that, when the fence adjust key 39 and the fence move key set 80 are operated and a command that specifies the moving direction is entered using the fence move key set 80, causes the stepping motor 51 to run so as to move the end fence 44 in the specified moving direction; and a feature that suspends printing until an end-of-operation signal for the side fences 42 and 43 or that for the end fence 44 is detected.

In the present embodiment, the end-of-operation signal is a stop signal to be issued after the stepping motor 51 stops running. The image-ratio data is data indicating a ratio of an area of an image to be printed on the paper P and denotes master-image data for use in driving signals for the thermal head 25 included in the master making unit 3.

Operations of the entire printer and operations, which are considered characteristic of the present invention, of the paper ejection device 40 are described below. The characteristic operations of the paper ejection device 40 are similar between single-sided printing and duplex printing. Accordingly, the operations of the entire printer are described only by way of example of single-sided printing, and description about operations in duplex printing is omitted.

When an original document is placed on the image reading unit 7 and the single-sided printing key is pressed by a user, a flag indicating that single-sided printing is selected is stored in the main control unit 90, which in turn calls up operation program instructions for single-sided printing. Thereafter, when the master-making start key 32 is pressed by the user, the image reading unit 7 scans the document to obtain a document image and, simultaneously, the master discharge unit 5 is activated to peel off the segmented-and-perforated master 14 or the perforated master 15 that has been used from the outer surface of the print drum 11. After the master is discharged, the master making unit 3 is activated to form a master image on the master 22 based on master-image data, thereby creating a new piece of the perforated master 15. The perforated master 15 is wrapped around the print drum 11.

After the wrapping operation is completed and the stencil printer 1 is put in a status waiting for single-sided printing to start, the user configures various print-condition settings such as print speed, paper type, and the number of sheets to be printed, and then presses the print start key 33. In response thereto, the print drum 11 is rotated at the thus-set print speed, and the paper feeding unit 4 feeds one sheet of the paper P. The fed paper P is temporarily stopped by the pair of registration rollers, and thereafter delivered toward between the print drum 11 and the pressing roller 12 at predetermined timing.

When the print drum 11 rotates a predetermined angle to bring the front-side area of the print drum 11 to a position facing the pressing roller 12, the pressing roller 12 is moved to the press-contact position. As a result, the paper P is pressed against the master image of the perforated master 15 on the print drum 11, and the image is transferred onto the paper P.

The printed paper P, onto which the image has been transferred, is guided by the guide member 10, which is at the first position, to the paper ejection unit 6 where the peel-off fan blows air to lift up the leading end of the paper P. Thereafter, the paper P is peeled off from the outer surface of the print drum 11 by a distal end of the peel-off claw. The peeled off, printed paper P is delivered to the paper-ejection conveying unit and, thereafter, conveyed to the paper ejection device 40 to be placed on (ejected onto) the paper output tray 41. The above operations are repeated until the set number of sheets are printed. When single-sided printing of the set number of sheets is completed, the units stop operating.

The operations, which are considered characteristic of the present embodiment, or, more specifically, control operations performed by the paper-ejection control unit 53 of decreasing spacing between the side fences 42 and 43 depending on a print speed are described below.

(1) When a print speed equal to or lower than, for instance, 120 sheets/minute is selected and then the print start key 33 is pressed, the spacing between the side fences 42 and 43 moves to a preset position.

(2) When a print speed faster than, for instance, 120 sheets/minute is selected and then the print start key 33 is pressed, the spacing between side fences 42 and 43 moves to a position narrower than the preset position by a certain amount. Meanwhile, "the certain amount" is, for instance, approximately 10 millimeters or, more specifically, 5 millimeters for each of the side fences 42 and 43.

(3) When the print speed is faster than, for instance, 120 sheets/minute (the print speed varies from a printer to a printer and can be, for instance, 135 sheets/minute or 150 sheets/minute), position adjustment of the side fences 42 and 43 is performed in the following manner:

(3a) the position adjustment is performed only when thin paper or standard paper is selected; but (3b) when special paper, such as thick paper, post card, or envelope, is selected, move from the preset position is not performed.

The description presented above is on an assumption that the paper ejection device is an automatic paper ejection device. However, similar effect to that yielded by the automatic paper ejection can be obtained from a printer using a paper output platform for manual paper ejection by causing similar operations to those described above to be performed (not automatically but manually).

Meanwhile, during high-speed printing, maintaining an elastically bent form of paper becomes less easy due to factors, such as an increase in air resistance applied to the paper. The factors become small when the paper has a small size in the direction perpendicular to the conveying direction. Accordingly, the spacing between the side fences 42 and 43 for such paper will be set to be wider than that for paper of a large size. The factors, such as the increase in air resistance applied to paper during high-speed printing, that act against maintaining an elastically bent paper form become large when the paper is thin paper that weighs less than 45 kg. Accordingly, the spacing between the side fences for such paper will be set to be narrower than that for standard paper that weighs approximately 55 kg (in basis weight).

In a high temperature-humidity environment, the factors, including the increase in air resistance applied to paper during high-speed printing, that act against maintaining an elastically bent paper form become large. Accordingly, the paper discharge device may be configured to include a sensor 75 for detecting temperature and humidity of an environment where the paper discharge device is installed and set the spacing between the side fences 42 and 43 in a high temperature-humidity environment to be narrower than that in normal temperature-humidity environment.

It should be recognized that the embodiment described herein is meant to be illustrative only and should not be taken as limiting the scope of the present invention. Those having ordinary skill in the art will recognize that the illustrated embodiment can be modified in a number of ways within the scope of the invention.

According to an aspect of the embodiment, it is possible to maintain an elastically bent form of paper even at high printing speeds, thereby preventing poor alignment of ejected paper.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper ejection device for holding paper ejected out from an upstream device through a paper-ejection opening of the upstream device, the paper ejection device comprising:

a pair of side fences arranged parallel to a paper ejection direction, the paper ejection direction being a direction in which paper is ejected through the paper-ejection opening, to restrict positions of edges of the ejected paper in a width direction;

an environmental-temperature-and-humidity detector that detects an environmental temperature and humidity; and a control unit that, when an ejection speed, obtained by an ejection speed detector, at which the paper is ejected through the paper-ejection opening is higher than a set speed, controls spacing between the pair of side fences to be narrower than spacing between the pair of side fences for paper ejected at a speed equal to or lower than the set speed, and the control unit further changes the spacing between the pair of side fences depending on the environmental temperature and humidity detected by the environmental-temperature-and-humidity detector.

2. The paper ejection device according to claim 1, further comprising a driving mechanism that changes the spacing between the side fences, wherein the control unit controls the driving mechanism based on the ejection speed data obtained by the ejection speed detector so as to reduce the spacing between the pair of side fences in the case of high speed printing.

3. The paper ejection device according to claim 1, wherein the control unit changes the spacing between the pair of side fences depending on at least one of a size and thickness of the paper.

4. The paper ejection device according to claim 1, wherein when the environmental temperature and humidity detected by the environmental-temperature-and-humidity detector is a high-temperature-and-humidity environment, the control unit sets the spacing between the pair of side fences to be narrower than spacing for a normal temperature-humidity environment.

5. An image forming apparatus comprising:

an image forming unit; and a paper ejection device for holding paper ejected out from an upstream device through a paper-ejection opening of the upstream device, the paper ejection device comprising:

a pair of side fences arranged parallel to a paper ejection direction, the paper ejection direction being a direction in which paper is ejected through the paper-ejection opening, to restrict positions of edges of the ejected paper in a width direction;

an environmental-temperature-and-humidity detector that detects an environmental temperature and humidity; and a control unit that, when an ejection speed, obtained by an ejection speed detector, at which the paper is ejected through the paper-ejection opening is higher than a set speed, controls spacing between the pair of side fences to be narrower than spacing between the pair of side fences for paper ejected at a speed equal to or lower than the set speed, and the control unit changes the spacing between the pair of side fences depending on the environmental temperature and humidity detected by the environmental-temperature-and-humidity detector.

6. The image forming apparatus according to claim 5, further comprising a driving mechanism that changes the spacing between the side fences, wherein the control unit controls the driving mechanism based on the ejection speed data obtained by the ejection speed detector so as to reduce the spacing between the pair of side fences in the case of high speed printing.

7. The image forming apparatus according to claim 5, wherein the control unit changes the spacing between the pair of side fences depending on at least one of a size and thickness of the paper.

8. The image forming apparatus according to claim 5, wherein when the environmental temperature and humidity detected by the environmental-temperature-and-humidity detector is a high-temperature-and-humidity environment, the control unit sets the spacing between the pair of side fences to be narrower than spacing for a normal temperature-humidity environment.

* * * * *